US009399367B2

(12) United States Patent
Schaffnit et al.

(10) Patent No.: US 9,399,367 B2
(45) Date of Patent: Jul. 26, 2016

(54) MARKER WITH DECORATIVE FLUID SLEEVE

(71) Applicants: Jim A. Schaffnit, North Ridgeville, OH (US); Gary E. Johnston, Avon, OH (US); Shannon K. Gallagher, Lakewood, OH (US)

(72) Inventors: Jim A. Schaffnit, North Ridgeville, OH (US); Gary E. Johnston, Avon, OH (US); Shannon K. Gallagher, Lakewood, OH (US)

(73) Assignee: Arrow International, Inc., Cleveland, OH (US)

( * ) Notice: Subject to any disclaimer, the term of this patent is extended or adjusted under 35 U.S.C. 154(b) by 65 days.

(21) Appl. No.: 14/458,003

(22) Filed: Aug. 12, 2014

(65) Prior Publication Data

US 2015/0050066 A1 Feb. 19, 2015

Related U.S. Application Data

(60) Provisional application No. 61/866,197, filed on Aug. 15, 2013.

(51) Int. Cl.

| | |
|---|---|
| ***B43K 5/12*** | (2006.01) |
| ***B43K 8/00*** | (2006.01) |
| ***B43K 29/007*** | (2006.01) |
| ***B43K 5/00*** | (2006.01) |
| ***B43K 23/008*** | (2006.01) |
| ***B43K 29/00*** | (2006.01) |
| ***B43M 11/00*** | (2006.01) |

(52) U.S. Cl.

CPC ..... *B43K 8/003* (2013.01); *B43K 5/005* (2013.01); *B43K 23/008* (2013.01); *B43K 29/00* (2013.01); *B43K 29/007* (2013.01); *B43M 11/00* (2013.01)

(58) Field of Classification Search

CPC ..... B43K 5/005; B43K 8/003; B43K 23/008; B43K 29/007

USPC ..... 401/44, 45, 47, 192, 195

See application file for complete search history.

(56) References Cited

U.S. PATENT DOCUMENTS

| | | | | |
|---|---|---|---|---|
| 2,321,998 | A | 6/1943 | Crouch et al. | |
| 3,200,995 | A | 8/1965 | Gangwisch | |
| D253,455 | S | 11/1979 | Beene | |
| 4,874,107 | A | 10/1989 | Arnau-Munoz et al. | |
| 5,713,681 | A | 2/1998 | Venne et al. | |
| 6,095,705 | A * | 8/2000 | Phillips | B43K 5/005 401/202 |
| 6,174,098 | B1 * | 1/2001 | Yeh | B43K 5/005 40/334 |
| D455,782 | S | 4/2002 | Singh et al. | |
| 6,571,977 | B2 | 6/2003 | Goncalez et al. | |
| 6,890,118 | B2 | 5/2005 | Oike | |
| 6,913,405 | B2 | 7/2005 | Fischer et al. | |
| 7,594,589 | B2 * | 9/2009 | Potts | B65D 47/12 215/6 |
| 8,403,178 | B2 | 3/2013 | May et al. | |
| 2004/0223804 | A1 * | 11/2004 | Ruiz | B43K 5/005 401/195 |
| 2012/0132667 | A1 | 5/2012 | May | |
| 2012/0145717 | A1 | 6/2012 | Paterson et al. | |

OTHER PUBLICATIONS http://www.ebay.com/itm/Bingo-Daubers-Markers-Dazzle-Glitter-Ink- . . . , "Bingo Daubers Markers Dazzle Glitter Ink—Set of Six—New Colors—3 oz—New!!!", 2 pages, Jul. 23, 2013.

* cited by examiner

*Primary Examiner* — Jennifer C Chiang

(74) *Attorney, Agent, or Firm* — Fay Sharpe LLP

(57) ABSTRACT

A dual chamber container includes an inner hollow body containing a marker fluid which is adapted to be dispensed. The inner hollow body is at least partially surrounded by an outer hollow body containing a decorative fluid which is retained in the container as the marker fluid is dispensed.

19 Claims, 7 Drawing Sheets

MARKER WITH DECORATIVE FLUID SLEEVE

This application claims the benefit of Provisional Application Ser. No. 61/866,197 filed on Aug. 15, 2013. The entire disclosure of that application is incorporated herein by reference.

FIELD OF THE DISCLOSURE

The present disclosure relates to fluid containers such as ink applicator bottles or markers. One use for such markers is for marking bingo paper or bingo cards with a daub of colored ink to indicate which numbers on a particular bingo face have been called. Of course, other uses of such markers are also contemplated for marking items requiring the application of an ink thereto. In addition, the fluid container could be employed as an applicator for applying various types of fluidic materials to a wide variety of surfaces.

BACKGROUND

Many fluid applicators, particularly ink applicators have been developed for use by persons to mark various paper products, for example bingo cards and bingo paper. While the prior art applicator bottles are suitable for their intended purposes, such bottles or containers nevertheless still leave something to be desired from the standpoint of applicators which are convenient, fun and easy to hold. Particularly desirable would be applicators which are decorative and provide a display which changes as the marker is turned from its upright storage position to an inverted position for use in marking products.

Multi compartment container packages of various constructions are known. However, in such packages, for example squeeze bottles, the material is discharged from both containers in the package. Such packaging is also known for use in the field of laundry detergent for washing machines. Again, the contents of both compartments are discharged. It would be advantageous to provide a dual chambered container in which only the contents of one container or compartment are dispensed or discharged whereas the contents of the other container or compartment remain in the package.

SUMMARY

One embodiment of the present disclosure pertains to a dual chamber marker including an inner hollow body containing a marker fluid or ink adapted for dispensing. At least a portion of the inner hollow body is surrounded by an outer hollow body containing a decorative fluid which is retained in the marker.

In accordance with another embodiment of the present disclosure, a dual chamber container is provided. The dual chamber container comprises a first chamber and a second chamber at least partially enclosing the first chamber. A joint is defined between cooperating portions of the first and second chambers. A first fluid is held in the first chamber and a second fluid is held in the second chamber. A dispensing opening communicates with the first chamber through which opening the first fluid is dispensed. The joint is adapted to retain the second fluid in the second chamber and prevent a dispensing of same as the first fluid is dispensed.

BRIEF DESCRIPTION OF THE DRAWINGS

The disclosure may take physical form in certain parts and arrangements of parts, several embodiments of which will be described in detail in this specification and illustrated in the accompanying drawings which form a part hereof and wherein.

DETAILED DESCRIPTION

Figure 1:
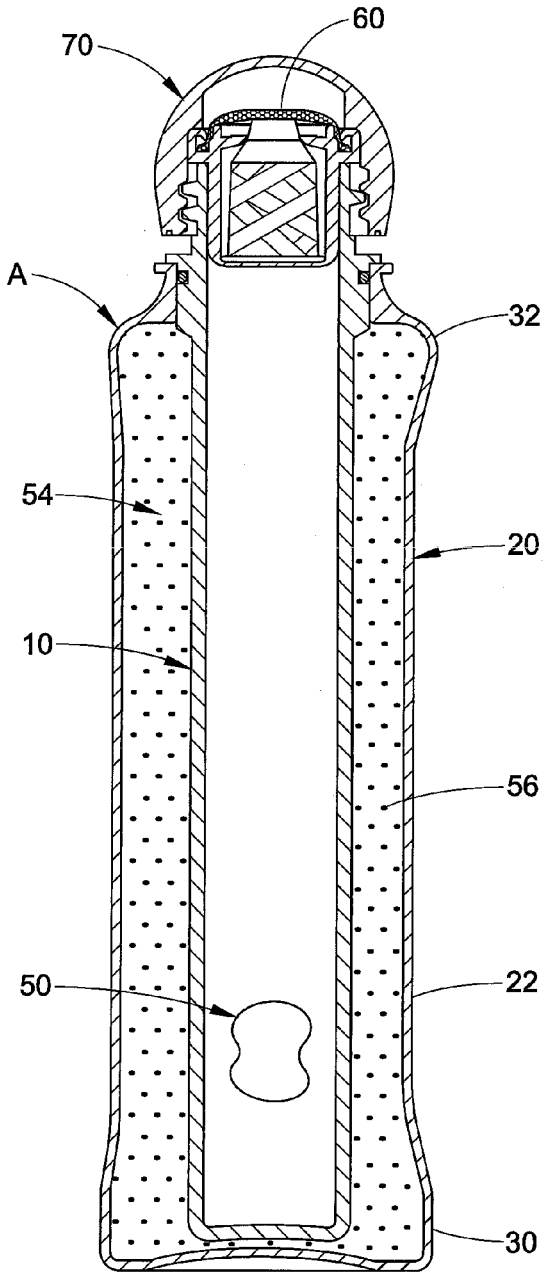
FIG. 1 is a cross-sectional view of a dual chamber fluid container in the form of a marker according to one embodiment of the present disclosure taken along a first axis.

Referring now to the drawings, wherein the showings are for purposes of illustrating several embodiments of the disclosure only and not for purposes of limiting same, FIG. 1 shows a dual chamber fluid container in the form of a marker bottle which can also be termed an applicator A. The applicator includes a first hollow body or inner container 10 comprising a generally cylindrical side wall 12 terminating in a bottom wall 14 at its lower end. The first hollow body also includes an open upper end 16. Enclosing the first hollow body 10 is a second hollow body or outer container 20.

Figure 2:
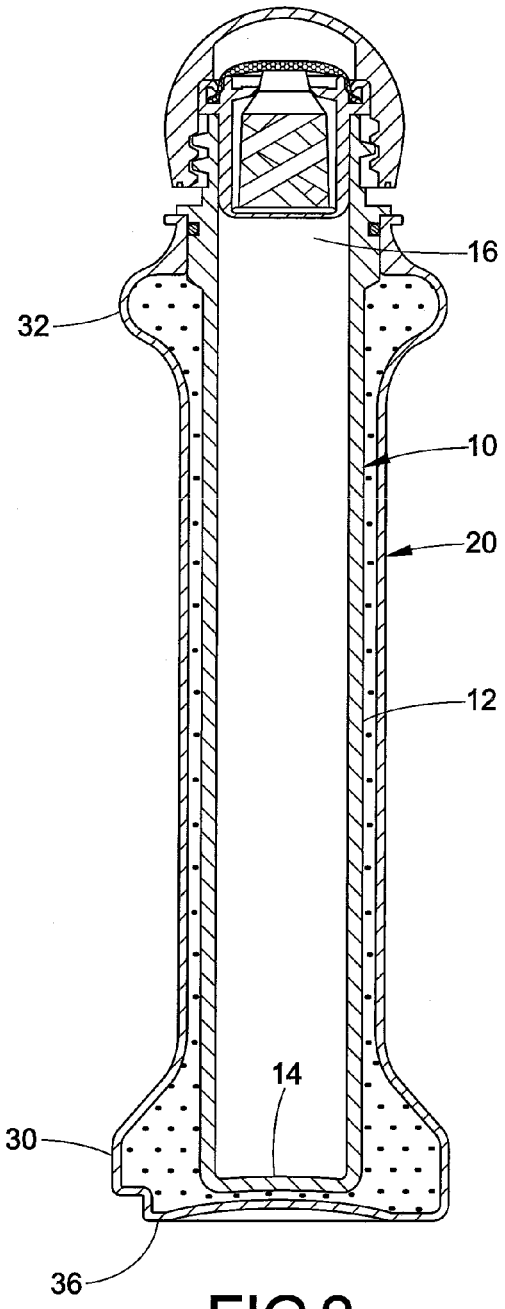
FIG. 2 is a cross-sectional view of the marker FIG. 1 taken along a second axis which is oriented generally transverse to the first axis.
Figure 3:
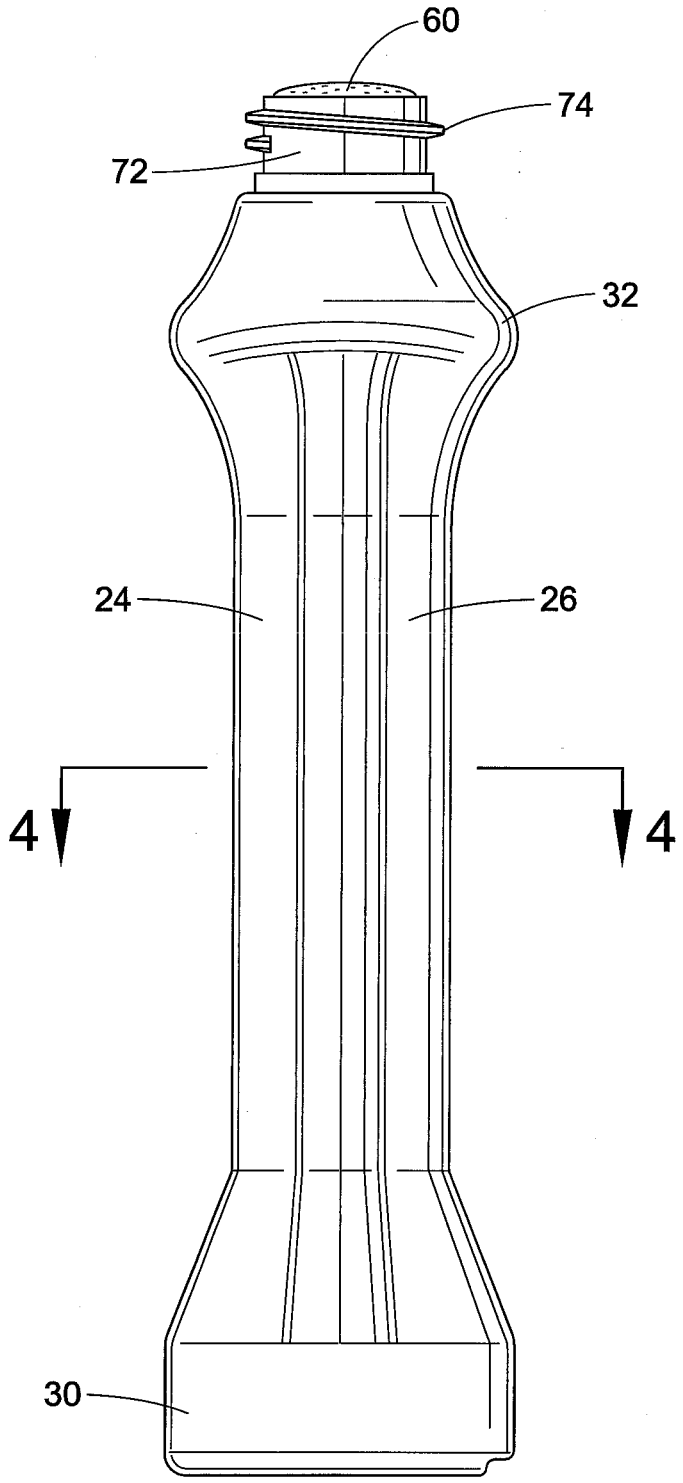
FIG. 3 is a front elevational view of the marker of FIG. 2 on a reduced scale.
Figure 4:
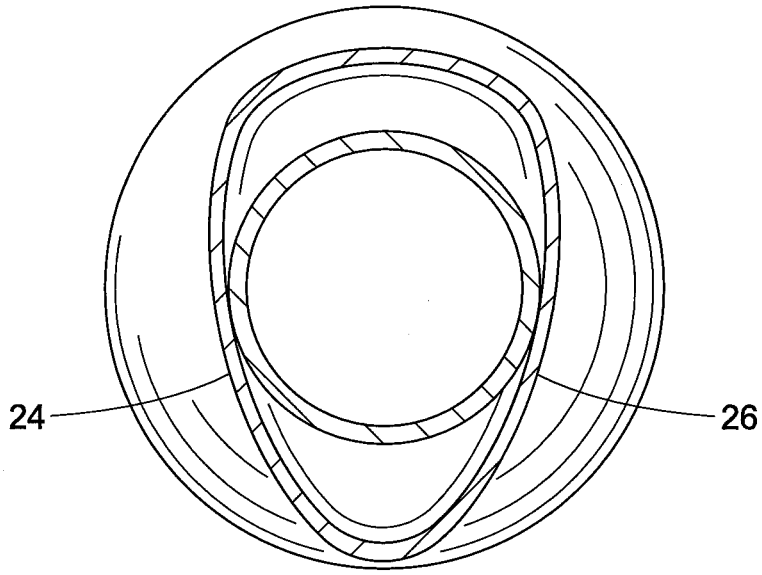
FIG. 4 is an enlarged cross-sectional view of the marker of FIG. 3 along line 4-4.
Figure 5:
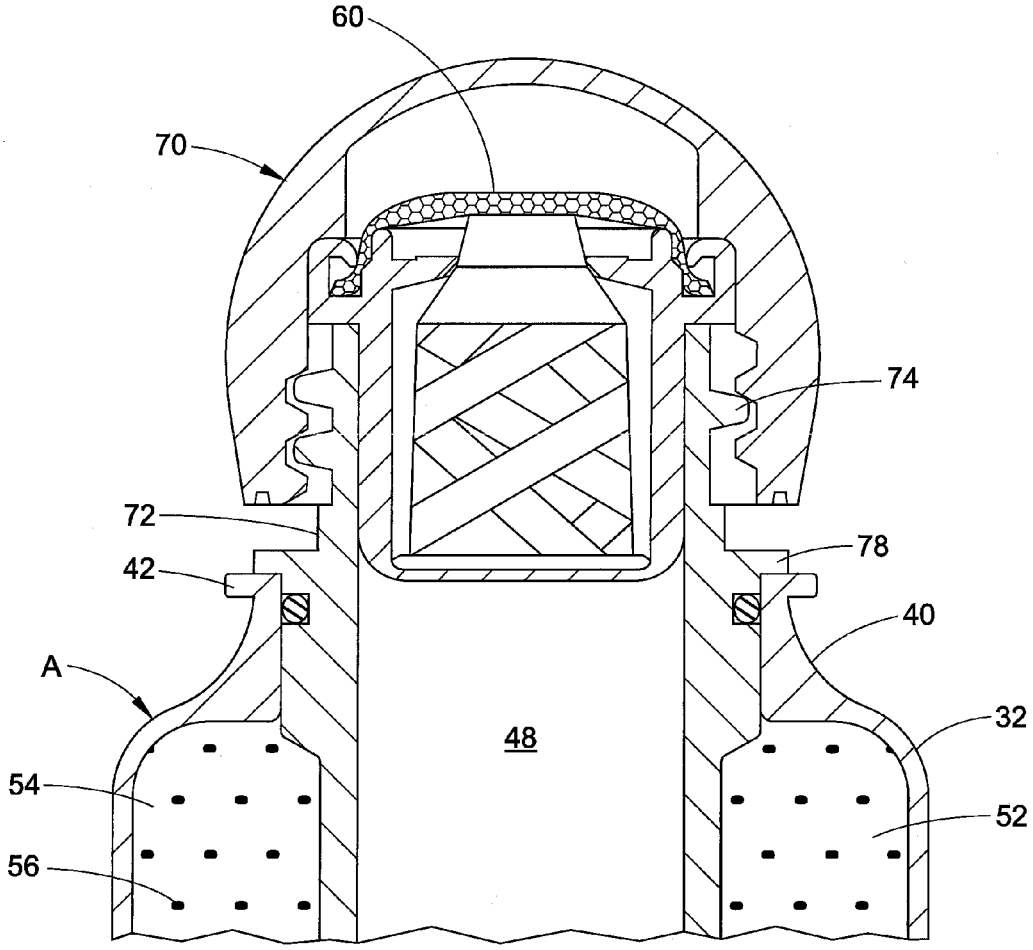
FIG. 5 is a greatly enlarged view of an upper end of the marker of FIG. 1.

The second hollow body comprises a side wall 22 (FIG. 1) which includes a first indented section 24 and a second indented section 26, as best seen in FIG. 3. The first and second indented sections extend along a longitudinal axis of the applicator A and are located generally in the central portion of the applicator. The second hollow body 20 also includes a lower end section 30 and an upper end section 32 as best seen in FIGS. 2 and 3. It is apparent that the upper and lower end sections 32 and 30 are located, respectively, above and below the two indented sections 24 and 26. In sum, the two indented sections 24 and 26 give the second hollow body, and hence the applicator A, a somewhat wedge shaped or triangular look at its central portion as can be seen in the cross-sectional view of FIG. 4. As best seen in FIG. 3, the applicator is elongated and has a generally cylindrical appearance, bearing in mind the two indented sections. The second hollow body 20 also comprises a bottom wall 36 serving as the base wall for the applicator A and a neck 40. With reference now to FIG. 5, the neck 40 terminates in a flange 42.

The first hollow body 10 encloses a first chamber 48 for holding an ink or marker liquid 50 as shown in FIG. 1. It should be appreciated that the ink can be of any desired color. The space between the first hollow body 10 and the second hollow body 20 defines a second chamber 52 which can hold a second fluid 54.

In one embodiment, the second fluid 54 located in the second chamber 52 can comprise a liquid such as glycerin or glycol. Alternatively, the liquid can be a light oil or even water. Also located in the second chamber 52 is a plurality of flakes or particles which can for the sake of convenience be referred to as "snow". These flakes can comprise small particles of aluminum foil or the like shiny material, hence the term snow. The snow can be of different sizes in order to provide a decorative look to the fluid 54 in the second chamber 52. The snow is added to the fluid 54 in the second chamber before that chamber is sealed, as discussed below. A benefit of using glycerin or glycol is that it slows the descent of the "snow" when the marker is inverted from its storage position to its use position. This gives a decorative appearance to the marker when it is employed for marking paper products such as bingo sheets or the like. The second chamber 52 serves as a container for holding the fluid 54 through which the "snow" falls. To activate the snow, the marker can be inverted or shaken or rotated. Such movement churns the particles 56 in the fluid 54 and gives a decorative appearance to the marker as the snow falls in the second chamber 52.

With further reference to FIG. 5, the marker includes an applicator 60 through which the ink 50 flows out when a cap 70 is removed from the applicator A and the applicator is inverted. The cap encloses a neck 72 of the first hollow body 10 and can be threaded onto the applicator A via a helical thread 74 defined on the neck. The neck 72 of the first hollow body also includes a flange 78 which mates with the flange 42 of the second hollow body 20. The fluid 54 and flakes or "snow" 56 held in the second chamber 52 are sealed in the applicator when the flange 78 of the first hollow body 10 is mated with the flange 42 of the second hollow body 10.

It should be appreciated that there is no communication between the first chamber 48 defined in the first hollow body 10 and the second chamber 52 defined between the first hollow body 10 and the second hollow body 20. Thus, the ink 50 held in the first chamber 48 does not mix with the fluid 54 held in the second chamber 52. While the ink 50 flows out through the applicator 60, the fluid 54 held in the second chamber is trapped and remains in applicator A. thus, the volume of fluid in the second chamber does not decrease while the volume of ink in the first chamber decreases. In this way, the decorative function performed by the fluid in the second chamber does not change even as the ink contained in the first chamber is dispensed.

The first and second hollow bodies 10 and 20 can be manufactured from a variety of materials. Plastic type materials are preferred such as either low density or high density polymer materials. The applicator can be made of a blow molded plastic material if so desired. Needless to say, the second hollow body 20 is made of a transparent material so that the falling of the snow is visible as the applicator is shaken, rotated or turned upside down. The first hollow body 10 can be transparent, translucent or opaque as may be desired for a particular application or use.

As might be appreciated, any conventional marking ink can be held in the first chamber 48. That ink is in communication with the applicator 60 when the marker is inverted. With the cap 70 removed and the applicator 60 brought in an engagement with a bingo sheet or other item to be marked, the applicator 60 will apply a circular blot of colored ink to a bingo sheet, card or item.

The marker is arranged to be held in the crook of a hand between the thumb and index finger of the user. With the marker inverted, it can be manipulated like a pencil, pen, or other writing instrument. When the marker is no longer needed, the cap 70 can be screwed back onto the neck 72 thereby sealing the applicator 60 from the ambient air and preventing it from drying out and or allowing the ink to evaporate.

The height of the marker A can be any desired dimension. In one embodiment, the height can be approximately 6 inches (15.2 centimeters) measured from the second hollow body bottom wall 36 to the top of the cap 70. The diameter of the bottom wall 36 can be approximately 1¾ inches (4.45 centimeters). In the disclosed embodiment, the indented central section of the marker A is somewhat elliptical as is evident from FIG. 4. It can have a major diameter of about 1.75 inches (4.45 centimeters) and a minor diameter of about 1.125 inches (2.86 centimeters).

The use of the marker will be primarily dictated by the type of applicator or tip which is employed. A variety of tips are contemplated such as a roller tip, a daubing tip, a marking tip, or a fountain tip.

It is contemplated that the dual chamber fluid container disclosed herein can have a variety of uses. While it can be used to apply ink to a writing surface, it can also be used to apply a polish to shoes, or apply paint to a surface that is being painted. It can even be used to apply glue to a substrate surface.

Figure 6:
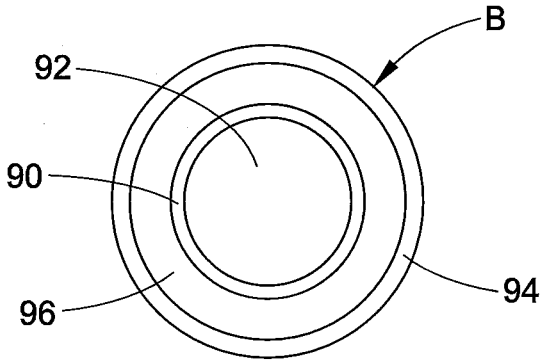
FIG. 6 is a cross-sectional view of a dual chamber fluid container according to another embodiment of the present disclosure.

With reference now to FIG. 6, another embodiment of the present disclosure includes a dual chamber fluid container B which comprises a first hollow body 90 defining a first fluid chamber 92. The first hollow body 90 is encircled by a second hollow body 94. Defined between the outer periphery of the first hollow body 90 and the interior periphery of the second hollow body 94 is a second chamber 96. The embodiment illustrated in FIG. 6 shows a design in which the cross-sectional view through the container B illustrates that the second fluid chamber 96 extends generally symmetrically around the first fluid chamber 92. In other words, it is unlike the cross-sectional view shown in FIG. 4. Thus, a dual chamber container according to the present disclosure can have a second chamber of any desired shape while still fulfilling its function of providing a second chamber or sleeve for holding a decorative fluid which is not dispensed when an ink or other fluid held in a first chamber 92 is being dispensed. In other words, the two fluids contained in the respective chambers do not communicate with each other.

Figure 7:
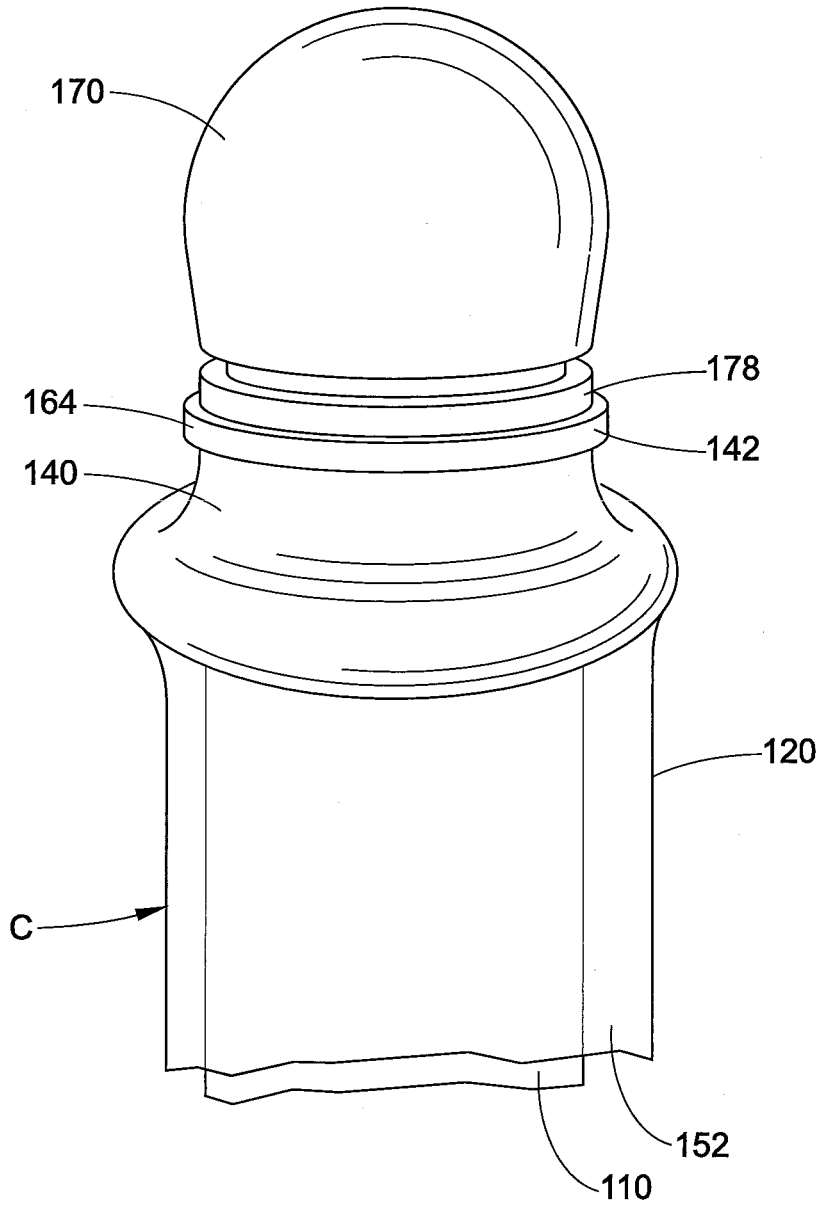
FIG. 7 is a side elevational view of a dual chamber fluid container according to still another embodiment of the present disclosure.

With reference now to FIG. 7, still another embodiment of the present disclosure includes a generally cylindrical dual chamber fluid container C which comprises a first hollow body 110 that includes at its open end a flange 178 and a second hollow body 120 which includes on a neck 140 thereof a flange 142. The second hollow body 120 can be transparent whereas the first hollow body 110 can be translucent. Also, the second hollow body can encircle the first hollow body. In this embodiment, positioned between the flanges 178 and 142 is a gasket or seal 164. The purpose of the gasket is to better seal a chamber 152 defined between the outer surface of the first hollow body 110 and the inner surface of the second hollow body 120. As is known in the art, the seal can be in the form of a silicon O-ring or any suitable known sealing ring which prevents a fluid contained in the second chamber 152 from flowing out of the fluid container C. As in the other embodiments, a cap 170 is employed to seal the fluid container C.

Figure 8:
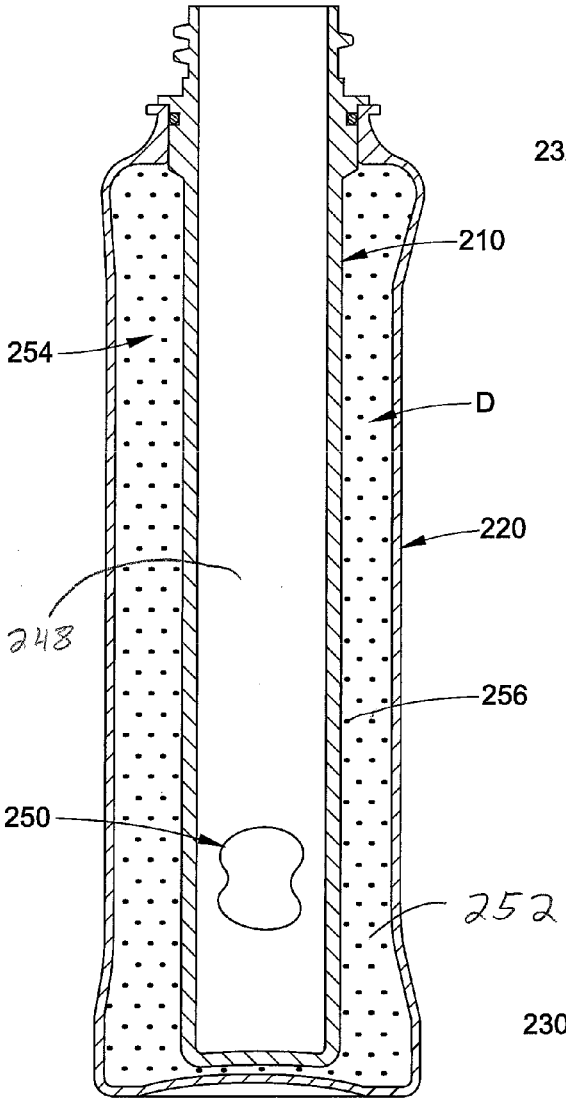
FIG. 8 is a cross-sectional view of a dual chamber fluid container in the form of a marker according to a further embodiment of the present disclosure taken along a first axis.

With reference to FIG. 8, shown there is a further embodiment of the present disclosure. This embodiment includes a first hollow body 210 which is generally surrounded by a second hollow body 220. The second hollow body 220 can be transparent whereas the first hollow body can be translucent if so desired. The first hollow body 210 encloses a chamber 248 for holding an ink or marker liquid 250. The space between the first hollow body 210 and the second hollow body 220 defines a second chamber 254 which can hold a second fluid 256.

In one embodiment, the second fluid 256 can comprise liquid such as glycerin or glycol. Also located in the second chamber 254 is a plurality of flakes or particles which can, for the sake of convenience, be referred to as "snow". These flakes can comprise small particles of aluminum foil or the like shiny material. In one embodiment, the fluid can be 50% glycerin and 50% water by weight (44% glycerin and 56% water by volume). The fluid can be treated with a biocide such as benzisothiazolinone (BIT). In one embodiment, the particles can be of two different sizes, namely, 1.0 mm hex glitter plus 0.2 mm hex glitter. The glitter can be made of a holographic polyethylene terephthalate (PET). Of course, other such plastic resins or other similar materials could be used instead. The larger particles held in the second chamber 254 can be approximately three times the weight of the smaller particles if so desired. The color of the particles can be as desired. In one embodiment, the particles can be silver in color.

Figure 9:
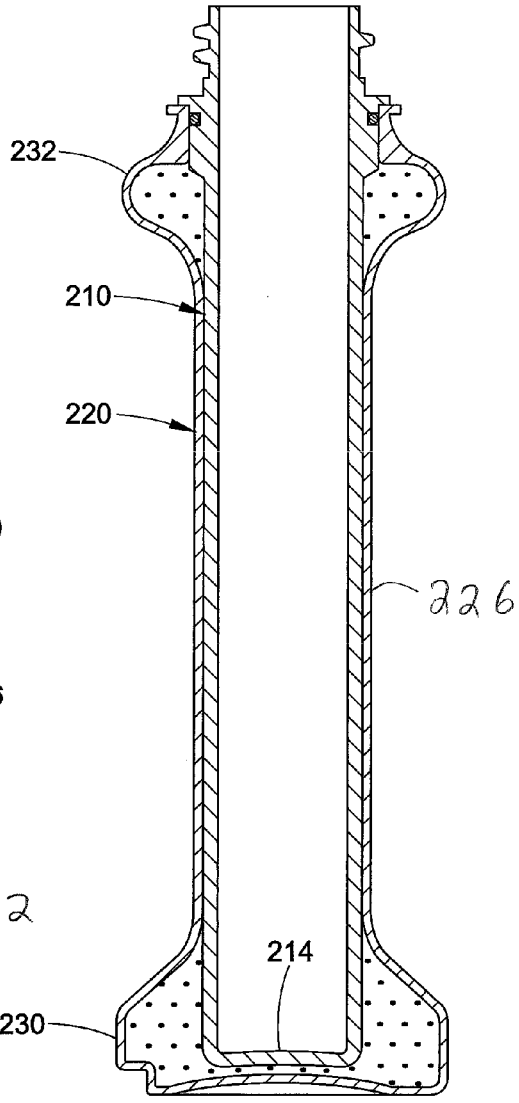
FIG. 9 is a cross-sectional view of the marker of FIG. 8 taken along a second axis which is oriented generally transverse to the first axis.

The applicator can include a lower end section 230 and an upper end section 232 which are of enlarged diameter in relation to an indented central section 226 as illustrated in FIG. 9. As can be seen from a comparison of FIGS. 8 and 9, the applicator has a varying central section. It can have a somewhat triangular shape in a perspective view. This shape allows the applicator to be more easily grasped than can a purely cylindrical applicator.

Figure 10:
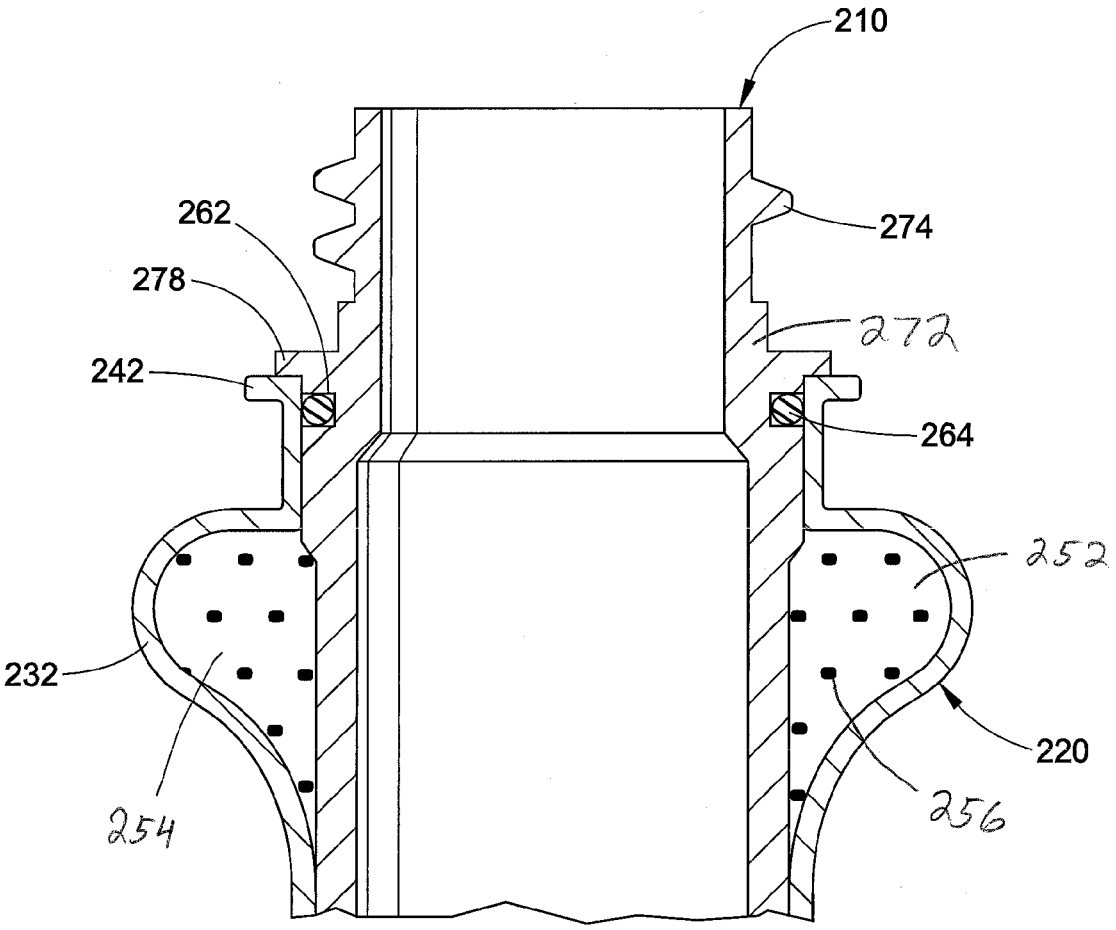
FIG. 10 is an enlarged cross-sectional view of a portion of the marker of FIG. 9.

With reference now to FIG. 10, an applicator section of the marker includes a neck 272 of the first hollow body 210. It also includes a flange 278 which mates with a flange 242 of the second hollow body 220. The fluid 254 and the flakes or "snow" 256 are held in the second chamber 252 and are sealed in the applicator when the flange 278 of the first body is mated with the flange 242 of the second body 210. In order to prevent any leakage at this joint, there can be provided a gasket 264 mounted in an annular opening 262 of the body 210. In one embodiment, the gasket 264 can be an O-ring made of a suitable elastomeric material such as a clear silicon elastomer having a Shore-A hardness or durometer of 60-70.

Disclosed has been a dual chamber fluid container which can be generally a single use container for holding a first fluid which is dispensed and for holding a second fluid which is not dispensed. The second fluid can be located on the outer periphery of the first fluid so as to provide a decorative, and changing, appearance to the container as the container is being used.

In one embodiment, the container comprises a generally rigid enclosure having an overall elongated cylindrical shape and having an opening at one end. As mentioned, the inner and outer compartments may contain any desired liquids, powders or like fluent materials which are kept apart. While the contents of one compartment are dispensed, the contents of the other compartment can remain in the container.

Disclosed has been a dual chamber container which comprises first and second chambers that do not communicate with each other and in which only the contents of one of the first and second chambers is dispensed whereas the contents of the other of the first and second chambers is retained in the container.

The exemplary embodiments of the present disclosure have been described with reference to several embodiments. Obviously, modifications and alterations will occur to others upon a reading and understanding of the preceding detailed description. It is intended that the disclosure not be limited to the embodiments described. Rather, the present invention should be construed as including all of the modifications and alterations which come within the scope of the appended claims or the equivalents thereof.

The invention claimed is:

1. A marker comprising:

an inner hollow body containing a fluid adapted for dispensing, wherein at least a portion of the inner hollow body is surrounded by an outer hollow body containing a decorative fluid which is retained in the marker;

wherein the inner hollow body comprises a side wall and a base wall;

wherein the outer hollow body comprises a side wall and a base wall, wherein the base wall of the outer hollow body is located adjacent the base wall of the inner hollow body; and a gasket disposed at a joint between the side wall of the inner hollow body and the side wall of the outer hollow body, the gasket retarding leakage of the decorative fluid at the joint.

2. The marker of claim 1 wherein an upper end of the inner hollow body protrudes away from an upper end of the outer hollow body, the upper end of the inner hollow body including a helical thread defined thereon.

3. The marker of claim 2 further comprising an applicator mounted to the upper end of the inner hollow body.

4. The marker of claim 1 further comprising a cap adapted to cooperate with the helical thread defined on the upper end of the inner hollow body.

5. The marker of claim 1 wherein the inner hollow body is generally cylindrical in shape and the outer hollow body includes an indented portion.

6. The marker of claim 5 wherein the indented portion comprises a central section of the outer hollow body.

7. The marker of claim 6 wherein the indented portion comprises a pair of spaced planar surfaces.

8. The marker of claim 1 wherein the inner hollow body includes a thickened outer peripheral section which cooperates with a section of the outer hollow body at the joint to define an annular bore in which the gasket is located.

9. The marker of claim 1 wherein the decorative fluid includes glitter particles.

10. A dual chamber dispenser comprising:

a first chamber defined by a first container, wherein an upper end of the first container includes a neck having a helical thread defined thereon;

a second chamber defined by a second container, wherein the second container at least partially encloses the first container and wherein the upper end of the first container protrudes away from an upper end of the second container;

a joint defined between cooperating portions of the first and second containers;

a first fluid held in the first chamber;

a second fluid held in the second chamber;

a dispensing opening defined in the first container and communicating with the first chamber through which the first fluid is dispensed;

an applicator for dispensing the first fluid, the applicator mounted to the upper end of the first container over the dispensing opening; and a gasket disposed at the joint to retard leakage at the joint and to retain the second fluid in the second chamber as the first fluid is dispensed.

11. The dispenser of claim 10 wherein the first container is generally cylindrical in shape and the second container contains an indented portion.

12. The dispenser of claim 11 wherein the indented portion comprises a central section of the second container.

13. The dispenser of claim 12 wherein the indented portion comprises a pair of spaced planar surfaces.

14. The dispenser of claim 10 wherein the first fluid comprises a marker fluid.

15. The dispenser of claim 14 wherein the second fluid comprises glitter particles.

16. The dispenser of claim 15 wherein the glitter particles are adapted to move in the second fluid as the marker fluid is dispensed.

17. The dispenser of claim 10 further comprising a cap adapted to cooperate with the helical thread defined on the neck, the cap thereby sealing the applicator from ambient air.

18. The dispenser of claim 10 wherein the applicator comprises a daubing tip.

19. The dispenser of claim 10, wherein the first container includes a thickened outer peripheral section which cooperates with a section of the second container at the joint to define an annular bore in which the gasket is located.

* * * * *